United States Patent [19]

Gestetner et al.

[11] Patent Number: 4,535,690

[45] Date of Patent: Aug. 20, 1985

[54] DUPLICATING STENCIL

[75] Inventors: Jonathan Gestetner, London; Cyril Green, Cockfosters; Thomas Hanrahan, London, all of England

[73] Assignee: Gestetner Manufacturing Limited, London, England

[21] Appl. No.: 475,623

[22] Filed: Mar. 15, 1983

[30] Foreign Application Priority Data

Jan. 28, 1983 [GB] United Kingdom ..... 8302373

[51] Int. Cl.[3] ..... B41N 1/24; B41L 13/14

[52] U.S. Cl. ..... 101/127; 101/128.2; 427/285; 428/192

[58] Field of Search ..... 101/127, 128.1, 128.2; 428/192; 427/285

[56] References Cited

U.S. PATENT DOCUMENTS

| | | | |
|---|---|---|---|
| 1,437,505 | 12/1922 | Fargo | 427/285 |
| 1,773,968 | 8/1930 | Dreyfus | 428/192 |
| 1,904,628 | 4/1933 | Pelton | 427/285 |
| 1,954,805 | 4/1934 | Drew | 101/127 |
| 1,981,152 | 11/1934 | Rooney | 428/192 |

FOREIGN PATENT DOCUMENTS

| | | | |
|---|---|---|---|
| 173192 | 7/1906 | Fed. Rep. of Germany . | |
| 312511 | 5/1919 | Fed. Rep. of Germany . | |
| 337082 | 5/1921 | Fed. Rep. of Germany | 427/285 |
| 375072 | 5/1923 | Fed. Rep. of Germany . | |
| 2531549 | 1/1977 | Fed. Rep. of Germany | 101/127 |
| 748367 | 4/1933 | France . | |
| 3472 | of 1898 | United Kingdom | 427/285 |
| 233932 | 5/1925 | United Kingdom . | |
| 237090 | 7/1925 | United Kingdom . | |
| 450223 | 7/1936 | United Kingdom . | |
| 454510 | 10/1936 | United Kingdom . | |
| 568854 | 4/1945 | United Kingdom | 427/285 |
| 2072581 | 10/1981 | United Kingdom . | |
| 2101041 | 1/1983 | United Kingdom . | |

OTHER PUBLICATIONS

Kirk-Othmer's *Encyclopedia of Chemical Technology*, Interscience Publishers, 2nd Ed., vol. 17, pp. 337-339.

Kirk-Othmer's *Encyclopedia of Chemical Technology*, Interscience Publishers, vol. 20, 1982, pp. 168-170.

*Primary Examiner*—Clyde I. Coughenour

*Attorney, Agent, or Firm*—Cushman, Darby & Cushman

[57] ABSTRACT

Duplicating stencils of the kind used on typewriters and word-processors are given a much improved working life by providing the stencil sheet with flexible reinforcement at that part of the sheet which first contacts the sheet of paper which receives the duplicated image, and between the upper limit of the area of the sheet which is imaged and the adjacent edge.

1 Claim, No Drawings

DUPLICATING STENCIL

This invention relates to duplicating stencils designed to be imaged by pressure, for example by the impact of a Dot Matrix Printer, a Daisy Wheel Printer, or a typewriter character. As used herein, the term "duplicating stencil" refers to unimaged stencil blanks unless otherwise stated. Duplicating stencils are often referred to as mimeograph stencils.

Pressure-sensitive duplicating stencils commonly consist of a sheet of light-weight foraminous tissue, so-called "stencil tissue", impregnated with a pressure-sensitive plastics material. In use, the plastics material is displaced by the pressure of the imaging device so that the stencil tissue is exposed. In use on the duplicating machine, the exposed stencil tissue offers no resistance to the passage of the duplicating ink, while the unimaged areas do not allow the ink to penetrate. To assist in mounting the duplicating stencil on the duplicating machine, it is usual for the stencil to be provided at one end, corresponding to the top of the imaged area, with a strip of thin perforated card, the so-called "heading", joined to the stencil tissue.

Modern imaging devices such as Word Processors making use of Daisy Wheel or Dot Matrix Printers, and electronic typewriters, often exert very much less pressure during the printing process than do conventional typewriters. For this reason, it has been necessary to provide, for use with such modern machinery, duplicating stencils requiring much less pressure for imaging. Unfortunately, it has been found that these more sensitive duplicating stencils have a reduced life on the duplicating machine, so that the maximum number of copies which can be produced from them is substantially less than with the older type of duplicating stencils.

Whatever the exact constitution of the duplicating stencil, analysis of the way in which an imaged duplicating stencil breaks down during use on a duplicating machine has shown that such breakdown follows a constant pattern, and this has made it possible to provide an improved duplicating stencil from which it is possible to obtain a much larger number of duplicated copies than with a conventionally manufactured stencil.

We have found that imaged duplicating stencils wear out first at a point close to the heading. This point corresponds to a point at which the paper sheet which is to receive the duplicated image first strikes the imaged duplicating stencil on the duplicating machine. Since the movement of the paper through the machine is partly caused by contact with the stencil sheet, it follows that a certain force is exerted on the latter which causes it to wear. In this connection, it is to be noted that modern duplicating machines have great accuracy of register, so that each successive sheet of paper to receive the duplicated image strikes the imaged stencil sheet at essentially the same point. Furthermore, modern methods of paper cutting cause the sheet of paper which is to receive the duplicated image to have an edge which has microscopic paper fibres protruding from it. The impact of these fibres on the imaged duplicating stencil sheet significantly adds to the wear.

It is necessary in practice for the impregnated stencil tissue to extend appreciably beyond the area which is to receive the image. In particular, there is normally a strip about 4 cm. (or about 2 inches) in width between the heading and the highest point on the stencil sheet likely to receive any image. This 4 cm. strip is required mainly to bridge the gap between the inking screen on the duplicating machine and the point of attachment of the heading to the machine, but a small proportion (about a quarter) is required to cover the area at the top of the sheet receiving the duplicating image which usually receives no image. It is within this 4 cm. strip that the greatest part of the wear to the imaged duplicating stencil occurs in use.

The present invention accordingly provides a duplicating stencil capable of giving an increased number of duplicated copies before failure comprising a sheet of stencil tissue impregnated with an ink-impervious pressure-sensitive plastics coating, which is provided, at that part of the stencil sheet which first contacts the sheet of paper which receives the duplicated image and between the upper-limit of the area of the sheet which is to be imaged and the adjacent edge, which is normally the heading, with a flexible reinforcement sufficient to increase the durability of the imaged stencil in use.

A wide variety of different means of providing this flexible reinforcement is possible, but it is essential that the flexibility of the impregnated stencil tissue is not substantially reduced. This, for example, it is not satisfactory simply to use a larger heading, nor to replace the stencil tissue in the strip in question by tougher less flexible paper.

While it would be possible to achieve the appropriate reinforcement by adding to the duplicating stencil a separately made reinforcement strip of adequate flexibility at the desired point, it is preferred to achieve the reinforcement by applying to the duplicating stencil an additional thin coating of a flexible reinforcing composition. This coating may be applied to either side of the stencil sheet but is preferably applied to that side which in use of the duplicating stencil is in contact with the silk screen of the duplicating machine and thus in contact with the ink supply. Any flexible resinous composition may be used provided it adheres adequately to the impregnation of the duplicating stencil sheet. However, it is preferable to use a composition which is similar to that used to form the ink-impervious coating of the stencil sheet, i.e. a composition based on highly plasticized nitrocellulose. However, the proportion of plasticizer in the composition should be less than in the conventional ink-impervious impregnation, and in particular it is preferred to use a composition containing 0.5–2 parts by weight of a plasticizer such as castor oil for each part by weight of nitrocellulose. Such compositions are not in general stencilizable but this is not a disadvantage since, as already explained, the area in which the reinforcement is required is outside the area which normally receives the image to be copied.

The reinforcing coating can be, and preferably is, very light, e.g. from 2–4 grams per square meter of sheet. It may be applied in the form of a solution in an appropriate solvent, e.g. industrial methylated spirit and ethyl acetate, of an appropriate film forming resin, for example cellulose acetate butyrate, cellulose acetate propionate or preferably nitrocellulose, and a plasticizer such as oleyl alcohol, castor oil mineral oil, tritolyl phosphate, diethylene glycol or dibutyl phthalate, the proportions of film forming resin and plasticizer being within the ranges already mentioned. An antioxidant may also be included in the composition to improve the shelf life of the stencil.

The impregnated stencil sheet carrying the reinforcing coating may also carry any of the usual top coats conventionally applied to duplicating stencils. The reinforcing coating may itself be left uncoloured, in which case it is usually practically invisible, or it may be coloured to distinguish it clearly from the other layers. A fluorescent marker dye may be incorporated if desired so that the reinforcement becomes visible under ultraviolet light.

Adaptation of existing apparatus for the manufacture of duplicating stencils to produce the improved stencils to the present invention presents no problem. It is usual for the web of impregnated stencil tissue to be fed through the machine for making the stencils sideways, and it is a simple matter to provide the machine also with an undercut roller such as a glue roller which applies a continuous 4 cm. wide strip of the reinforcement coating continuously to the web of impregnated stencil tissue at the right point.

The following Examples illustrate the invention.

EXAMPLES

A sheet of stencil tissue already impregnated with a stencilizable ink-impervious coating is reinforced by the application, to a 4 cm. wide strip at the head of the stencil sheet on that side which in use contacts the silk screen of the duplicating machine, of one of the following compositions:

| | | | |
|---|---|---|---|
| (i) | Nitrocellulose (Grade HM15 20 of ICI or Hagadorn H.8) | 100 | w/w |
| | Castor Oil | 200 | " |
| | Antioxidant | 10 | " |
| | Ethyl Acetate | 500 | " |
| | Ethyl Alcohol | 1,500 | " |
| (ii) | Nitrocellulose | 100 | " |
| | Castor Oil } Plasticizers | 50 | " |
| | Mineral Oil } Plasticizers | 50 | " |
| | Antioxidant | 10 | " |
| | Ethyl Acetate | 500 | " |
| | Ethyl Alcohol | 1,500 | " |
| (iii) | Nitrocellulose | 100 | " |
| | Mineral Oil } Plasticizers | 50 | " |
| | Chemfos X } Plasticizers | 20 | " |
| | Butyl Stearate } Plasticizers | 70 | " |
| | Coconut Oil } Plasticizers | 30 | " |
| | Antioxidant | 5 | " |
| | Ethyl Acetate | 500 | " |
| | Ethyl Alcohol | 1,500 | " |
| (iv) | Polyvinyl Chloride (Vinylite VYNS) | 100 | " |
| | Dioctyl Phthalate | 30 | " |
| | Methylethyl Ketene | 700 | " |

Each composition may be applied so as to give a coating weighing, after evaporation of the solvent, about 3 grams per square meter.

The stencilizable ink-impervious impregnation of the stencil sheet may have one of the following compositions:

| | | Parts by weight |
|---|---|---|
| (i) | Nitrocellulose H8 | 60 |
| | $TiO_2$ | 80 |
| | Oleic Acid } Plasticizers | 300 |
| | Ocenol } Plasticizers | 400 |
| | TXP } Plasticizers | 85 |
| | G44 } Plasticizers | 156 |
| | Castor Oil } Plasticizers | 190 |
| | Antioxidant | 7.5 |
| | Ethyl Acetate | 500 |
| | Industrial Methylated Spirit | 1,600 |
| (ii) | Nitrocellulose H8 | 100 |
| | Castor Oil } Plasticizers | 270 |
| | G44 } Plasticizers | 160 |
| | EHS } Plasticizers | |
| | Chemfos X } Plasticizers | 70 |
| | Ocenol } Plasticizers | 380 |
| | Antioxidant | 7.5 |
| | Blue Pigment | 30 |
| | Ethyl Acetate | 400 |
| | Industrial Methylated Spirit | 1,400 |
| (iii) | H8 | 85 |
| | Castor Oil } Plasticizer | 192 |
| | Butyl Stearate } Plasticizer | 130 |
| | Coconut Oil } Plasticizer | 70 |
| | Oleic Acid } Plasticizer | 220 |
| | Ocenol } Plasticizer | 270 |
| | $TiO_2$ | 35 |
| | Antioxidant | 7.5 |
| | Blue Pigment | 0.6 |
| | Industrial Methylated Spirit | 1,000 |
| | Ethyl Acetate | 350 |

Any known type of pressure-sensitive duplicating stencil may advantageously be reinforced in accordance with the present invention, but it is particularly advantageous to reinforce the more sensitive duplicating stencils especially formulated for imaging by Dot Matrix Printers or Daisy Wheel Printers exerting a relatively low pressure. The duplicating stencil sheet itself may be attached to the backing sheet only at the heading or it may be temporarily adhered over substantially all its area to the backing sheet as a so-called laminated stencil in the manner described, for example, in our British Patent Specification No. 1410059.

We claim:

1. In a duplicating stencil comprising:

a sheet of stencil tissue having an ink-impervious plastics impregnation comprising highly plasticized nitrocellulose which is capable of displacement by impact imaging, a heading fastened to one edge of the said sheet, and a backing sheet removably attached to said heading and adjacent to said sheet of stencil tissue, the improvement which consists in providing the said sheet of stencil tissue in an area between the heading and the image-receiving area of the said sheet with a thin, integral reinforcement coating comprising nitrocellulose which is less highly plasticized than the ink-impervious impregnation, which coating is resistant to imaging by impact, does not substantially reduce the flexibility of the impregnated stencil tissue and which renders the stencil resistant to abrasion by the leading edge of an image-receiving paper sheet.

* * * * *